US006253671B1

(12) United States Patent
Kayser

(10) Patent No.: US 6,253,671 B1
(45) Date of Patent: Jul. 3, 2001

(54) PROCESS FOR GLAZING A MATERIAL WEB AND ROLLER FOR A GLAZING CALENDER

(75) Inventor: Franz Kayser, Geldern (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/433,207

(22) Filed: Nov. 4, 1999

(30) Foreign Application Priority Data

Nov. 11, 1998 (DE) ..... 198 51 936

(51) Int. Cl.[7] ..... B30B 3/04

(52) U.S. Cl. ..... 100/35; 100/155 R; 100/176; 162/205; 428/36.3; 428/36.4; 492/20; 492/48; 492/59

(58) Field of Search ..... 100/35, 155 R, 100/176; 162/205; 428/36.1, 36.3, 36.4; 492/20, 48, 59

(56) References Cited

U.S. PATENT DOCUMENTS 3,852,862 * 12/1974 Sukenik ..... 492/48
4,324,177 * 4/1982 Tsuji et al. ..... 100/155 R
5,061,533 * 10/1991 Gomi et al. ..... 428/36.3
5,142,759 * 9/1992 Bonander et al. ..... 492/48
5,150,738 * 9/1992 Nishiwaki ..... 428/36.1
5,334,124 * 8/1994 Ohno ..... 492/59
5,746,124 * 5/1998 Kayser ..... 100/155 R
5,769,771 * 6/1998 van Haag .

OTHER PUBLICATIONS

"Innovations on Elastic Calender Covers," Gamsjager et al., presented at the SPCI, Stockholm, Jun. 4–7, 1996.*

* cited by examiner

*Primary Examiner*—Stephen F. Gerrity
(74) *Attorney, Agent, or Firm*—Greenblum & Bernstein, p.l.c.

(57) ABSTRACT

Process and apparatus for glazing a material web so as to influence or control the transparency of a material web. The material web is guided through at least one nip which is formed by a roller having an elastic covering made, in particular of a plastic reinforced with fibers or appropriate fillers, and an opposing roller. In one embodiment, a primary orientation of the fibers in the covering is selected as a function of the desired glazing result. In another embodiment, the roller surface has uniform nonhomogeneous hardness distribution over a substantial portion of its rolling surface.

31 Claims, 1 Drawing Sheet

PROCESS FOR GLAZING A MATERIAL WEB AND ROLLER FOR A GLAZING CALENDER

CROSS-REFERENCE TO RELATED APPLICATIONS

The present application claims priority under 35 U.S.C. §119 of German Patent Application No. 198 51 936.2, filed on Nov. 11, 1998, the disclosure of which is expressly incorporated by reference herein in its entirety.

BACKGROUND OF THE INVENTION

1. Field of the Invention

The invention concerns a process for glazing a material web, in particular a paper web, in which the material web is guided through at least one nip, which is formed by a roller having an elastic covering made of a plastic reinforced with fibers or appropriate fillers and an opposing roller. The invention further concerns a roller for a glazing calender with a uniform structure on its surface.

The invention is explained in the following with reference to a paper web as an example of a material web. It is, however, also applicable with other material webs for which the conditions are similar.

2. Discussion of Background Information

In one of the final production steps, a paper web is glazed, i.e., guided through at least one, but usually a plurality of nips or roll gaps of a calender, where it is subjected to pressure and high temperature. The paper web is more than merely compacted by this. It is also desirable to influence other properties of the paper web, for example, glaze and smoothness. Another property which can be influenced during glazing is transparency. In printing papers, high opacity, i.e., low transparency, is often desired. In contrast, in so-called technical papers, such as silicon paper, glassine, and drawing paper, high transparency is often desired.

High transparency is obtained with prior art super-calenders when glazing is performed under high temperature, high pressure, and high humidity. Here, a black glazing undesirable in other papers, is deliberately produced. It is assumed that in this glazing the paper fibers are crushed to a point at which light permeability is, in contrast, possible.

Tests have demonstrated that transparency may be deliberately influenced only with relatively great difficulty using plastic rollers, i.e., rollers with an elastic covering made of a fiber-reinforced plastic. In particular, it has been relatively difficult to date to produce high transparency using plastic rollers.

SUMMARY OF THE INVENTION

The invention resides in influencing or controlling the transparency of a material web using plastic rollers.

This is accomplished by a process of the type mentioned in the Background, in that the primary orientation of the fibers in the roller covering is selected as a function of the desired glazing result.

The orientation of the fibers in the covering is used as an additional influencing variable. To obtain high opacity, i.e., low transparency, fibers which lie substantially parallel to the roller surface are used. The paper web is then acted on by the "broad side" of the fibers such that the compressive stress is distributed over a relatively large zone of the reinforcing fibers. Accordingly, the local stress on the paper web, i.e., the stress on individual paper web fibers, remains low. In contrast, if high transparency is desired, then the fibers are oriented perpendicular to the roller surface, i.e., virtually radially. In this case, the paper web comes into contact with the cross-sections of the reinforcing fibers such that a compressive stress acting on a reinforcing fiber is substantially concentrated on the cross-section of this fiber. Accordingly, the paper web is relatively highly stressed locally, which results in the aforementioned crushing or destruction of the paper fibers, which is so extensive that light can pass through. This yields the desired high transparency. It is possible, within certain limits, to control the transparency of the paper web with the orientation of the fibers. If the fibers are oriented at an angle substantially between 90° and 0° relative to the surface of the roller, this yields different sized fiber cross-sections depending on the angle. These, in turn, are responsible for the appropriate stress on the surface of the paper web. The steeper the fibers stand, i.e., closer to 90°, the greater the transparency that is achievable. This basically involves only the orientation of the fibers on the roller surface. In lower-lying layers below this surface, differently oriented fibers may also be present or the individual fibers in lower layers may be folded. Consequently, a "primary orientation" refers only to the zone of the covering and below the surface which is provided for the processing of the paper web. Of course, the orientation of the fibers (in the following, the term "fibers" also always refers to comparable fillers) can be such that they can pass beyond the thickness of the covering, i.e., protruding. The selection of the fiber orientation takes place through the preparation and subsequent use of a roller with the desired fiber orientation.

Preferably, a fiber cross-sectional size and shape (e.g. diameter for a circular fiber) is selected as a function of the desired glazing result and the primary orientation of the fibers. The fiber cross-section size also naturally has an influence on the stress applied to the paper web or the paper web fibers. The greater the fiber diameter, for example, the greater the surface on which the pressure can be distributed. The distances between the fibers also increase according to the size of the fibers, i.e., the zones of the surface filled only with plastic become larger. Given that the "transparency" of a paper web results basically from an accumulation of very small spots, it is clear that it is possible to influence the degree of transparency by selecting the size of the spots.

The fiber cross-section is selected such that it corresponds to, for example, the diameter of the paper fiber. Alternatively, the fibers may have cross-sectional sizes and shapes which are polygonal, circular, oval, or other similar shapes. While the fibers are described herein in terms of a diameter cross-section, other cross-sectional shapes are contemplated by the invention. Referring again to the paper web, it is further noted that paper fibers have a certain scatter range of their diameter. However, it suffices for the diameter of the reinforcing fibers to be within the range of the diameters of the paper fibers. In selecting the diameter of the reinforcing fibers, it is simultaneously possible to consider the type of paper web as well. Here also, there are certain differences in the diameter of the paper fibers. If the diameter of the reinforcement fibers is adapted to the diameter of the paper fibers, the practical result is that an adequate number of paper fibers are acted upon by a reinforcing fiber and thus crushed. Thus, the desired high transparency is achieved.

The invention is also attained by having a roller, of the type mentioned in the Background, include a uniform non-homogeneous hardness distribution over the entire surface.

With a roller of this type, it is possible to process the paper web very deliberately such that high transparency is obtained. The entire surface is macroscopically homogeneous, i.e., has a uniform surface structure. However, microscopically, the hardness of the surface differs from zone to zone. Thus, the hard zones are capable of crushing the paper fibers since an appropriately high compressive stress prevails there. In contrast, there is only a very low transfer of force to the paper web in the soft zones. Since the "harder" and "softer" zones can be extremely close to each other and have only a very small area, it is possible to produce a group of light-permeable points in the glazed paper web which are so close together that the paper web as a whole obtains high transparency.

The surface has adjoining surface zones of different hardness, such that the size of an individual hard surface zone is on the order of the size of the diameter of a paper fiber. This applies at least to the size of the hard surface zones. The soft surface zones located between them may be even smaller. With such a design, it is guaranteed that an adequate number of paper fibers are acted upon with the necessary pressure to become transparent. The more zones of the paper web that become transparent, the greater the overall transparency.

The roller has an approximate surface roughness of Ra>0.1 $\mu$m. Accordingly, the hard zones can, for example, protrude by this value to crush the paper fibers.

In one embodiment, the roller has a coating made of a fiber-reinforced plastic in which the fibers, at least on the surface, are more than 90% radially oriented and have a different hardness from the plastic. As described above in connection with the process, a surface structure is thus obtained in which a large number of reinforcing fibers protrude with their cross-section into or through the surface. The plastic is then placed between these fibers. Since most of the reinforcing fibers are radially oriented, they also transfer the majority of the pressure onto the paper web and can thus effect a crushing of the individual fibers which results in the aforementioned increase in transparency. It is not necessary for the fibers to be perpendicular along their entire length. However, this makes production easier. Moreover, if the fibers are oriented perpendicularly along their entire length, the stiffness of the individual fibers is improved, which in turn improves the pressure transfer from the roller to the paper web.

The fibers are arranged in the form of a brush. The manufacture of brushes is known. It is possible to also use the techniques known for production of brushes to orient the reinforcement fibers and to attach them to the surface of the roller. When this has been accomplished, the plastic can then be applied on the roller and the roller then possibly lathed to produce the desired hardness distribution in the surface.

It is particularly preferred for the fibers to be disposed in the form of radially oriented roving sections. Rovings are bundles of fibers which can be relatively closely packed. Fibers considered are, for example, glass fibers whose diameter may be smaller than about 10 $\mu$m, for example, about 3 to 6 $\mu$m, or carbon fibers, whose diameter may be even smaller. It is not necessary for the diameter to be circular as stated above. The roving sections may be bundled with a length of, for example, about 1 to 2 cm and thus produce a brushlike or flowerlike surface layer, which may be applied to the surface of the roller. After the entire surface of the roller, or at least the surface in the working zone, is coated with the radially oriented roving sections, it is possible to apply synthetic resin or another plastic. After hardening, the roller can be lathed and/or ground to the desired geometry. In this case, substantially perpendicular carbon or glass fibers are obtained, closely packed with plastic between them.

According to one aspect of the invention, a process for glazing a material web is described wherein at least one nip is formed between a first roller and an opposing roller. An elastic covering is applied to the first roller. This elastic covering comprises a plastic reinforced with one of fibers or appropriate fillers. A primary orientation of the fibers or fillers in the covering is selected as a function of a desired glazing result. The process further includes guiding the material web, e.g., a paper web, through the at least one nip.

According to another aspect of the invention, the process includes orienting the fibers at an angle substantially between 90° and 0° relative to the surface of the first roller.

According to another aspect of the invention, the process includes selecting a cross-section of the fibers or fillers as a function of the desired glazing result and the primary orientation of the fibers or fillers. The process includes selecting a diameter of the fibers or fillers to substantially correspond to a diameter of the material web fibers.

According to another aspect of the invention, the process includes arranging the fibers or fillers in brush form. Alternatively, the fibers or fillers could be arranged in the form of radially oriented roving sections. The process may further include bundling the roving sections to produce, one of, a brushlike or flowerlike surface layer. Additionally, the roving sections may be bundled with a length of approximately 1 to 2 cm.

According to another aspect of the invention, the process includes selecting a diameter of the fibers or fillers to be less than about 10 $\mu$m, preferably in the range of about 3 to 6 $\mu$m. Alternatively, the fibers which comprise carbon fibers of a diameter smaller than about 3 $\mu$m could be used.

According to the invention, there is described a process for glazing a material web wherein at least one nip is formed between a first roller and an opposing roller. A uniform structure is applied to the first roller, and the uniform structure has a rolling surface. This surface has a uniform nonhomogeneous hardness distribution over a substantial portion of the surface. The process further includes guiding the material web through the at least one nip.

According to another aspect of the invention, there is described a roller for a glazing calender which includes a roller and a uniform structure having a rolling surface. The uniform structure has a uniform nonhomogeneous hardness distribution over a substantial portion of the rolling surface. The roller includes a material fiber web guided by said roller, the rolling surface having adjoining surface areas of varying hardness and wherein the size of a single hard surface area is on the order of the size of a diameter of the fiber of the material fiber web. The roller includes a rolling surface having an approximate surface roughness of Ra>0.1 $\mu$m. Additionally, the roller includes a structure which comprises a coating made of a fiber-reinforced plastic, in which more than 90% of the fibers, at least on the surface, are radially oriented and have a different hardness from the plastic.

According to another aspect of the invention, the roller includes fibers which are arranged in brush form. Alternatively, the roller includes fibers which are arranged in the form of radially oriented roving sections. Further, the roller includes roving sections which are bundled to produce, one of, a brushlike or flowerlike surface layer. The roller includes roving sections which are bundled with a length of approximately 1 to 2 cm.

According to another aspect of the invention, there is described a roller for a glazing calender which has a roller and a composite coating having a rolling surface on the roller. The composite coating has a uniform nonhomogeneous hardness distribution over a substantial portion of the rolling surface.

According to another aspect of the invention, an apparatus for glazing a material web comprises a first roller and an opposing roller. The first roller and opposing roller define at least one nip therebetween. The first roller has an elastic covering comprising a plastic reinforced with one of fibers or appropriate fillers, such that a primary orientation of the fibers or fillers in the covering is selected as a function of a desired glazing result. A material web, e.g., a paper web, is glazed by guiding it through the at least one nip of the apparatus. The apparatus includes fibers which are oriented at an angle substantially between 90° and 0° relative to the surface of the first roller. The first roller has an elastic covering which includes a cross-section of the fibers or fillers selected as a function of the desired glazing result and the primary orientation of the fibers or fillers. The apparatus includes fibers or fillers of a selected diameter which substantially correspond to the diameter of the material web fibers. The fibers or fillers have a diameter of less than about 10 $\mu$m, preferably, from about 3 to 6 $\mu$m. Further, fibers could comprise carbon fibers of a diameter smaller than about 3 $\mu$m.

According to another aspect of the invention, there is described an apparatus for glazing a material web. The apparatus has a first roller and an opposing roller. The first roller and opposing roller define at least one nip therebetween. The first roller includes a uniform structure which has a rolling surface such that the surface has a uniform nonhomogeneous hardness distribution over a substantial portion of the surface. A material web is glazed by guiding it through the at least one nip of the apparatus.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
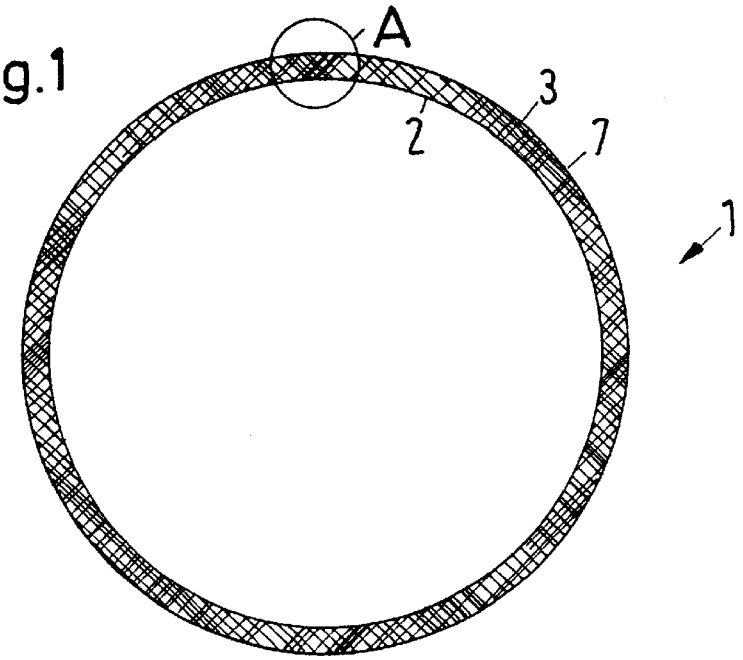
FIG. 1 is a schematic cross-section through a roller with an elastic coating.

FIG. 1 depicts a roller 1 in schematic cross-section. The roller 1 has a roller core 2 which may be solid or designed as a hollow body. An elastic coating or covering 3, which is depicted exaggeratedly thick here for clarity, is placed on the roller core. With a normal diameter of the roller 1 in the approximate range from 400 to 800 mm, the covering 3 has an approximate thickness in the range from 5 to 30 mm.

The covering 3 may be formed from a fiber-reinforced plastic. Fibers considered are, for example, carbon or glass fibers. The covering has a surface 7 with which the roller 1 comes into contact with a material web (not shown).

Figure 2:
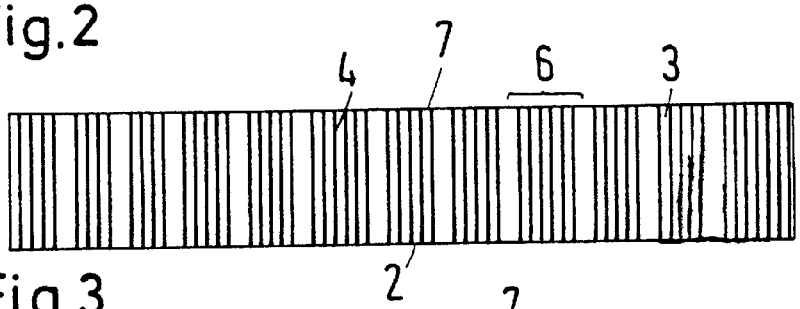
FIG. 2 shows the detail A from FIG. 1 in a first design.
Figure 4:
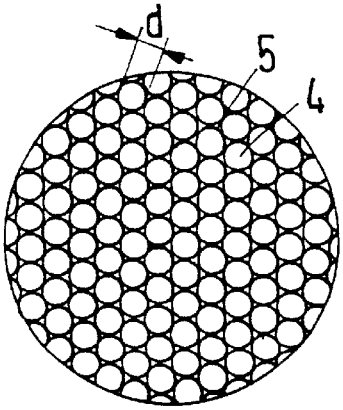
FIG. 4 shows a detail of a top view of the embodiment according to FIG. 2.

The fibers may be oriented variously. FIG. 2 depicts a detail A from FIG. 1, namely, the coating 3 on the roller core 2. It is discernible that a large number of fibers 4 are oriented perpendicularly to the surface of the roller core 2. FIG. 4 depicts a top view of this embodiment. The diameter d of the fibers here is on the order of the diameter of the paper fibers, i.e., substantially in the range from 1 through 5 $\mu$m. Between the individual fibers 4, there are surface zones 5 which are filled only with plastic, for example, an epoxy resin. Since the plastic is significantly softer than the fibers 4 made, for example, of carbon or glass, there is a local nonhomogeneous hardness distribution on the surface of the roller 1. That is, very hard zones which are formed by the cross-section of the fibers 4 alternate with relatively soft zones 5, which are formed by the plastic. This nonhomogeneous hardness distribution is, however, substantially uniform over the entire surface of the roller 1. Accordingly, a paper web (or a different material web) which is subjected to pressure by the roller 1 and an opposing roller (not shown) is processed uniformly over its entire width. Microscopically, in the size range of the paper fibers, there is, however, a nonuniform application of pressure by the variably hard zones of the surface. The ends of the fibers 4 can crush the individual paper fibers such that they become transparent.

Of course, the fibers 4 may also be arranged with a somewhat greater distance between them than that depicted in FIG. 4. In this case, the surface share of the surface zones 5 becomes somewhat greater. Even in this case, however, the diameter of the surface zones 5 should not be significantly larger than the diameter of a paper fiber.

In FIG. 2, fiber groups 6 depict that the fibers 4 are applied on the roller core 2 in the form of roving sections, for example, like a brush. Such a roving section can, for example, have a length of approximately 2 cm and a diameter of approximately 1 cm. This section then has many thousand individual fibers. After the fibers or fiber groups 6 are placed on the surface, the plastic may then be applied. For example, it is then possible to resin or recast and then lathe the surface of the roller 1.

Figure 3:
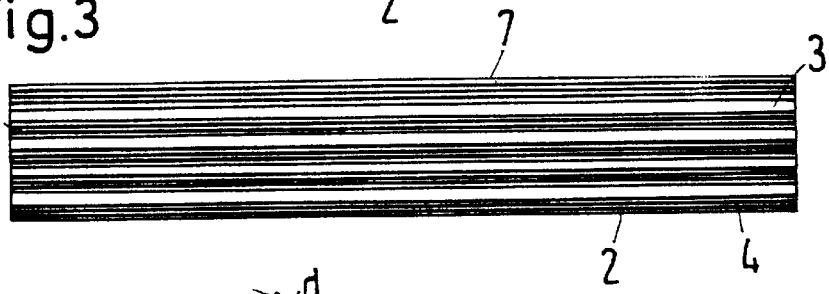
FIG. 3 shows the detail A from FIG. 1 in a second design.

FIG. 3 depicts an alternative embodiment. In this embodiment, the fibers 4 are parallel to the surface of the roller core 2. Here, the plastic of the covering 3 is merely reinforced. Local nonhomogeneity of the hardness distribution is largely avoided.

By selecting the fiber orientation, of which the two extremes are depicted in FIGS. 2 and 3, it is possible to influence the transparency of the material or paper web to be glazed. If a fiber orientation is selected in which the fibers 4 are substantially perpendicular to the surface of the roller core 2, i.e., radially oriented, relatively high transparency is obtained with appropriate pressure. In contrast, if a fiber orientation which runs substantially parallel to the surface of the roller core 2 is used, as depicted in FIG. 3, significantly higher opacity, i.e., lower transparency, is obtained with otherwise unchanged conditions.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for glazing a material web comprising:

forming at least one nip between a first roller and an opposing roller;

applying an elastic covering to said first roller, said elastic covering comprising a plastic reinforced with one of fibers or fillers, wherein a primary orientation of the fibers or fillers in the covering is selected as a function of a desired glazing result; and guiding the material web through the at least one nip.

2. The process of claim 1, wherein the material web is a paper web.

3. The process of claim 1, wherein the fibers are oriented at an angle substantially between 90° and 0° relative to the surface of the first roller.

4. The process of claim 1, further comprising selecting a cross-section of the fibers or fillers as a function of the desired glazing result and the primary orientation of the fibers or fillers.

5. The process of claim 4, further comprising selecting a diameter of the fibers or fillers to substantially correspond to a diameter of the material web fibers.

6. The process of claim 4, further comprising arranging the fibers or fillers in brush form.

7. The process of claim 4, further comprising arranging the fibers or fillers in the form of radially oriented roving sections.

8. The process of claim 7, further comprising bundling the roving sections to produce, one of, a brushlike or flowerlike surface layer.

9. The process of claim 7, further comprising bundling the roving sections with a length of approximately 1 to 2 cm.

10. The process of claim 4, further comprising selecting a diameter of the fibers or fillers to be less than about 10 $\mu$m.

11. The process of claim 10, wherein the diameter of the fibers or fillers is selected to be from about 3 to 6 $\mu$m.

12. The process of claim 10, wherein the fibers comprise carbon fibers of a diameter smaller than about 3 $\mu$m.

13. A process for glazing a material web comprising:

forming at least one nip between a first roller and an opposing roller;

applying a uniform structure to the first roller, said uniform structure having a rolling surface wherein the surface has a uniform nonhomogeneous hardness distribution over a substantial portion of the surface; and guiding the material web through the at least one nip.

14. A roller for a glazing calender comprising:

a roller;

a uniform structure having a rolling surface on said roller;

the uniform structure having a uniform nonhomogeneous hardness distribution over a substantial portion of the rolling surface.

15. The roller of claim 14, further comprising a material fiber web guided by said roller, the rolling surface having adjoining surface areas of varying hardness and wherein the size of a single hard surface area is on the order of the size of a diameter of the fiber of the material fiber web.

16. The roller of claim 15, wherein the structure comprises a coating made of a fiber-reinforced plastic, in which more than 90% of the fibers, at least on the surface, are radially oriented and have a different hardness from the plastic.

17. The roller of claim 16, wherein the fibers are arranged in brush form.

18. The roller of claim 16, wherein the fibers are arranged in the form of radially oriented roving sections.

19. The roller of claim 18, wherein the roving sections are bundled to produce, one of, a brushlike or flowerlike surface layer.

20. The roller of claim 18, wherein the roving sections are bundled with a length of approximately 1 to 2 cm.

21. The roller of claim 14, wherein the rolling surface has an approximate surface roughness of Ra>0.1 $\mu$m.

22. A roller for a glazing calender comprising:

a roller;

a composite coating having a rolling surface on said roller;

the composite coating having a uniform nonhomogeneous hardness distribution over a substantial portion of the rolling surface.

23. An apparatus for glazing a material web comprising:

a first roller;

an opposing roller;

said first roller and opposing roller defining at least one nip therebetween;

the first roller having an elastic covering, said elastic covering comprising a plastic reinforced with one of fibers or fillers, wherein a primary orientation of the fibers or fillers in the covering is selected as a function of a desired glazing result;

wherein the material web is glazed by guiding it through the at least one nip.

24. The apparatus of claim 23, wherein the material web is a paper web.

25. The apparatus of claim 23, wherein the fibers are oriented at an angle substantially between 90° and 0° relative to the surface of the first roller.

26. The apparatus of claim 23, wherein the elastic covering further comprises a cross-section of the fibers or fillers selected as a function of the desired glazing result and the primary orientation of the fibers or fillers.

27. The apparatus of claim 26, wherein a selected diameter of the fibers or fillers substantially corresponds to a diameter of the material web fibers.

28. The apparatus of claim 26, wherein the fibers or fillers have a diameter of less than about 10 $\mu$m.

29. The apparatus of claim 28, wherein the diameter of the fibers or fillers is selected to be from about 3 to 6 $\mu$m.

30. The apparatus of claim 28, wherein the fibers comprise carbon fibers of a diameter smaller than about 3 $\mu$m.

31. An apparatus for glazing a material web comprising:

a first roller;

an opposing roller;

said first roller and opposing roller defining at least one nip therebetween;

the first roller having uniform structure, said uniform structure having a rolling surface wherein the surface has a uniform nonhomogeneous hardness distribution over a substantial portion of the surface;

wherein the material web is glazed by guiding it through the at least one nip.

* * * * *